US009263220B2

(12) United States Patent
Krauss et al.

(10) Patent No.: US 9,263,220 B2
(45) Date of Patent: Feb. 16, 2016

(54) DEVICE FOR SURGE-CURRENT-RESISTANT THERMAL CONTACTING OF ELECTRICAL COMPONENTS

(71) Applicant: DEHN + SÖHNE GmbH + Co. KG, Neumarkt/Opf (DE)

(72) Inventors: Bernhard Krauss, Berg (DE); Stephan Hierl, Neumarkt (DE)

(73) Assignee: DEHN + SÖHNE GmbH + Co. KG, Neumarkt/Opf (DE)

( * ) Notice: Subject to any disclaimer, the term of this patent is extended or adjusted under 35 U.S.C. 154(b) by 0 days.

(21) Appl. No.: 14/389,666

(22) PCT Filed: Apr. 5, 2013

(86) PCT No.: PCT/EP2013/057163

§ 371 (c)(1),
(2) Date: Sep. 30, 2014

(87) PCT Pub. No.: WO2013/150128

PCT Pub. Date: Oct. 10, 2013

(65) Prior Publication Data

US 2015/0111412 A1 Apr. 23, 2015

(30) Foreign Application Priority Data

Apr. 5, 2012 (DE) ..... 10 2012 007 048
Jun. 5, 2012 (DE) ..... 10 2012 011 166

(51) Int. Cl.
*H01H 85/22* (2006.01)
*H01H 85/20* (2006.01)
(Continued)

(52) U.S. Cl.
CPC ..... *H01H 85/22* (2013.01); *H01H 85/202* (2013.01); *H01R 4/48* (2013.01); *H01R 33/975* (2013.01)

(58) Field of Classification Search
CPC ..... H01H 85/22; H01H 85/202
USPC ..... 439/366, 346, 830, 620.26, 620.29, 348
See application file for complete search history.

(56) References Cited

U.S. PATENT DOCUMENTS 1,917,860 A 7/1933 Wadsworth
2,802,920 A 8/1957 Kinnear, Jr.
(Continued)

FOREIGN PATENT DOCUMENTS

CH 291026 A 5/1953
DE 929205 C 6/1955
(Continued)

OTHER PUBLICATIONS

International Search Report and Written Opinion for PCT/EP2013/057163, dated Jul. 19, 2013.

*Primary Examiner* — Briggitte R Hammond
(74) *Attorney, Agent, or Firm* — Kinney & Lange, P.A.

(57) ABSTRACT

The invention relates to a device for surge-current-resistant terminal contacting of electrical components (3), in particular components of rotationally symmetrical form, wherein the components, on the lateral surface thereof, have spaced-apart contacting portions (7), also comprising two U-shaped, electrically conductive contact pads (1) which have a partial surface (4) which is complementary to the contour of the respective contacting portion of the electrical component. According to the invention, each contact pad is assigned a U-shaped spring clip which likewise has a partial surface (5) which is complementary to the contour of the respective contacting portion of the electrical component, wherein said partial surface is provided in the connecting portion between legs (6, 6') of the U-shaped spring clip. In the assembled state, the U legs of the spring clip protrude between the lateral surface of the electrical component and the respective U leg of the respective contact pad and are fixed with respect to one another in a latching manner.

8 Claims, 2 Drawing Sheets

(51) Int. Cl.
*H01R 4/48* (2006.01)
*H01R 33/975* (2006.01)

(56) References Cited

U.S. PATENT DOCUMENTS 4,126,368 A * 11/1978 Godfrey et al. ..... 439/354
4,547,036 A * 10/1985 Keglewitsch et al. ..... 439/680
4,950,195 A * 8/1990 Perreault et al. ..... 439/830
5,145,415 A * 9/1992 Doudon ..... 439/620.34
D517,504 S * 3/2006 Kitajima et al. ..... D13/178
7,564,337 B2 * 7/2009 Whitney et al. ..... 337/268

FOREIGN PATENT DOCUMENTS

EP 1194943 4/2002
FR 2795299 A1 12/2000
GB 2096413 A 10/1982

* cited by examiner

DEVICE FOR SURGE-CURRENT-RESISTANT THERMAL CONTACTING OF ELECTRICAL COMPONENTS

BACKGROUND

The invention relates to a device for the surge-current-resistant clamped contacting of electrical components, in particular components of a rotationally symmetrical form, the components having spaced-apart contacting portions on the lateral surface thereof, further comprising two U-shaped, electrically conductive contact jaws which have a partial surface that is complementary to the contour of the respective contacting portion of the electrical component.

Document EP 1 194 943 B1 discloses a fuse holder clip comprising two U-shaped clamping pieces which are intended to define between them a space for receiving the fuse capsule with a circular section. The clip having a substantially U-shaped design includes bent portions relative to the opposite U-legs, thus obtaining a mechanical support. This mechanical support extends along lines which are oriented parallel to the axis of the fuse capsule. Both the electrical connection and the mechanical support are realized by these contact lines. At the same time, a shaped portion in the U-legs ensures a secured position. The clips provided there have a spring-type function and are spread apart when the fuse capsule is inserted. However, a clip, respectively, clamping jaw configuration of this type is not resistant to a surge current. In addition, there is the risk that the inserted fuse member or fuse capsule is displaced in the event of vibrations or mechanical oscillations and moves out of the intended position.

In the fuse holder according to DE 929 205 contact holders for the conductor connection and for the contact fork are connected to the housing halves, receiving the fuse, by means of a helical spring. If the fuse is inserted, the helical spring acts as a tension spring and produces, respectively, maintains the contact pressure between the fuse and the receiving contacts. The helical spring configuration with the fuse received in the interior space of the helical spring prevents the fuse from being displaced out of the required position if mechanical vibrations occur.

Moreover, in one end of a sleeve intended for receiving the fuse, contact blades are formed which resiliently enclose the corresponding contact cap of the fuse. The respective shape of the contact blades is not realized in conformity with the lateral surface contour of the sleeve so that the contact obtained is only a punctiform or linear contact. Employing such a constructive solution in surge-current-resistant devices is not possible.

DE 929 205 further describes a bracket for receiving a spare fuse. This bracket has two spaced-apart securing clips which, in a cross-sectional view, have a shape that is adapted to the outer contour of the fuse so as to fix the latter in position in order not to get lost. Slots formed with different depths in the bracket cause independent spring forces in the individual portions of the bracket for holding the fuse and fixing the spare fuse holder on the helical spring.

SUMMARY

Based on the foregoing it is, therefore, the object of the invention to provide a further developed device for the surge-current-resistant clamped contacting of electrical components, in particular components of a rotationally symmetrical form, the components having spaced-apart contacting portions on the lateral surface thereof. It is desired to realize the device in a space-saving and constructively simple manner, and the contacting is to be resistant to surge currents, in particular resistant to lightning impulse currents. At the same time, a protection against the loss of contact material is to be obtained. In addition, the mounting of the device should be easy to realize, and a variability is desired with respect to unavoidable tolerances of the electrical component to be contacted.

Accordingly, there is proposed a device for the surge-current-resistant clamped contacting of electrical components, in particular components of a rotationally symmetrical form. These components can be, for instance, cylindrical fuses with metallic contact caps on the opposite end thereof.

The spaced-apart contacting portions provided, in this respect, on the lateral surface of the components are to be electrically connected to the device. The device further comprises two U-shaped, electrically conductive contact jaws which have a partial surface that is complementary to the contour of the respective contacting portion of the electrical component.

The complementary contour mentioned in this respect is a region of the lateral surface of the electrical component, viz. where the contacting portions are located.

Given the above-mentioned aspect and the task to obtain a current-carrying capacity, it is desired to accomplish a contacting between the contact jaws and the electrical component on a surface area that is as large as possible. Punctiform or linear contacts, as found in the prior art, should be avoided.

According to embodiments of the invention, a substantially U-shaped spring clip is assigned to each contact jaw, which likewise includes a partial surface that is complementary to the contour of the respective contacting portion of the electrical component.

This partial surface is provided in the connecting portion between the legs of the U-shaped spring clip. In the assembled state, the U-legs of the spring clip immerse between the lateral surface of the electrical component and the respective U-leg of the respective contact jaw and are fixed with respect to one another in an engaged manner.

In a preferred embodiment, snap-in orifices are provided in the legs of the spring clip, in which snap-in catches of the clamping jaws engage in a self-locking manner. Here, it is in accordance with the invention to perform a kinematic reversal between the snap-in catches and snap-in orifices with respect to the spring clips and clamping jaws.

The spring clips comprise, in the transition region between the lateral legs and the leg connecting portion, a shoulder-shaped portion which, in the assembled state, builds up a spring force, wherein, for this purpose, the shoulder-shaped portions do not rest against the lateral surface of the component.

Depending on the case of application, the current-carrying capacity can be predetermined by the size of the partial surfaces of the contact jaws without leaving the principle according to the invention.

In a preferred embodiment, the locked fixing between the clamping jaws and the spring clips may be configured to be free from a current flow. To this end, the spring clips are either configured to be non-conducting, or have an electrical insulating layer, respectively, insulating intermediate layer with respect to the contacting portions of the electrical component.

In one embodiment of the invention, the contact jaws may include connection extensions and/or solder contacts. The connection extensions may be configured as screwed contacts, plug contacts or the like.

In one embodiment of the invention, the clear inner distance of the U-legs of the clamping jaws substantially corresponds to the diameter or width of the electrical component in the region of the contacting portions thereof. Again, it is preferred that the aforementioned clear inner distance is greater by a small amount than the diameter, respectively, width of the electrical component in the region of the contacting portions. The dimensional difference with respect to the clear inner distance of the U-legs of the clamping jaws and the diameter or width of the electrical component is such that the spring clips can be easily introduced into the desired position between the clamping jaw and the electrical component and fixed there in an engaged manner.

In a preferred embodiment of the invention, the rigidity and material strength of the clamping jaws is greater than those of the spring clips. The material choice and material properties of the spring clip are primarily directed to the easy assembly and producing the desired preload spring force, whereas the material used for the clamping jaws is chosen under the aspect of an optimum current-carrying capacity. Thus, with regard to their desired functions, the aforementioned components can be optimized independently of each other.

It is, of course, also in accordance with embodiments of the invention that the spring clips, too, are configured to be electrically conductive for carrying a partial current.

The invention will be explained in more detail below my means of an exemplary embodiment and with reference to the figures.

DETAILED DESCRIPTION

Figure 1:
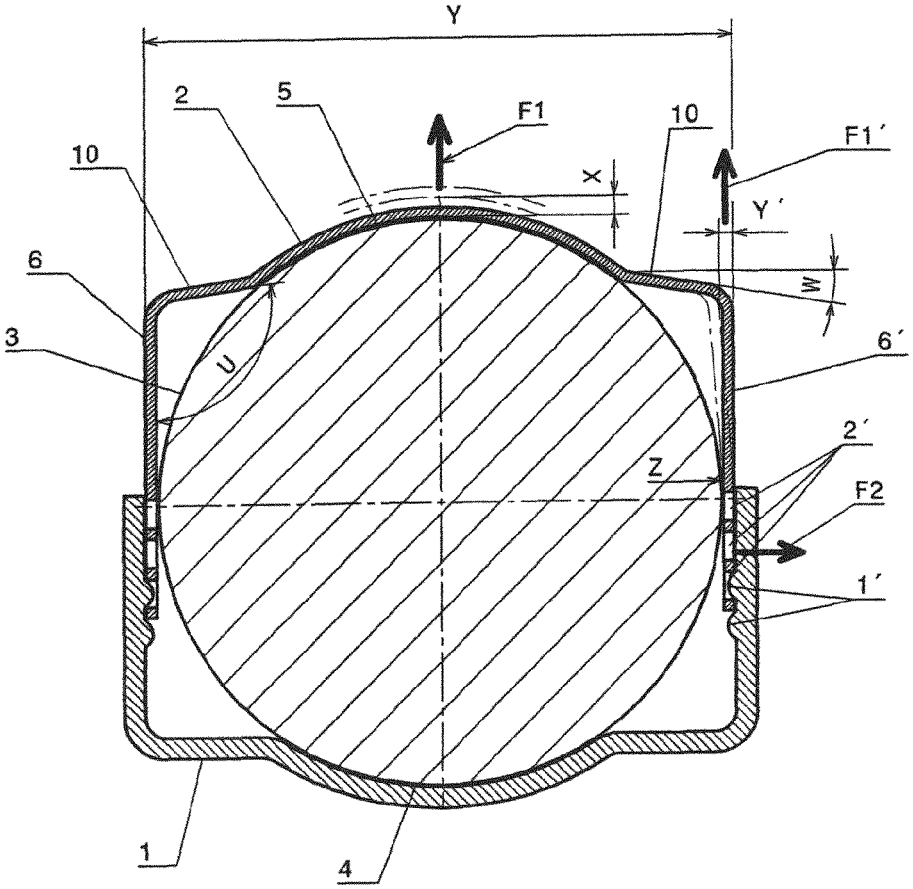
FIG. 1 shows a cross-section through the device for the surge-current-resistant clamped contacting of a substantially cylindrical electrical component according to the invention, comprising a contact jaw, respectively, clamping jaw and a U-shaped spring clip.

The device according to the invention as illustrated in FIG. 1 is initially based on an electrical component 3. This component (see FIG. 2) may be designed rotationally symmetrically, in particular cylindrically, and be configured in the form of a fuse with opposite contact surfaces 7.

To allow for an electrical contact of the contact surfaces 7 two electrically conductive contact jaws 1 are provided, which have a partial surface 4 that is complementary to the contour of the respective contacting portion 7 of the electrical component 3.

Each contact jaw 1 is assigned a U-shaped spring clip 2, which likewise has a partial surface 5 that is complementary to the contour of the respective contacting portion 7 of the electrical component 3.

This partial surface 5 is provided in the connecting portion between legs 6 and 6' of the U-shaped spring clip 2.

In the assembled state, the U-legs 6, 6' of the spring clip 2 immerse between the lateral surface of the electrical component 3 and the respective U-leg of the respective contact jaw 1 and are fixed with respect to one another in an engaged manner. In order to accomplish this locked engagement, the legs 6, 6' of the spring member 2 are provided with window-type recesses 2' in which corresponding snap-in catches 1' engage. The snap-in function may be realized in multiple stages so as to increase the contact force on the surfaces 4 and 5. This multi-stage snap-in possibility is realized by means of several orifices 2' and snap-in catches 1' arranged in a row.

The respective spring clip 2 comprises, in the transition region between the lateral legs 6, 6' and the leg connecting portion 5, a shoulder-shaped portion 10 which, in the assembled state, builds up the desired spring force. For this purpose, the shoulder-shaped portions 10 do not rest against the lateral surface, respectively, contact surface 7 of the component 3.

The contacting device is hence made of a receiver, which is formed by the clamping jaw made of an electrically conductive material and a counterpart in the form of a spring clip 2.

The electrical component 3, which has external conducting surfaces, is contacted by the above-mentioned means so as to transmit currents.

The contact jaw, respectively, clamping jaw 1 is geometrically designed in the region of the contact surface 4 to partially fix the electrical component 3 with respect to the position thereof.

In this regard, the corresponding contact jaw is ideally formed such that a shape is obtained that is complementary to the electrical component in the region of the contact surface 4.

By attaching the spring clip 2 from above the contact is established between the electrical component 3 and the respective contact jaw 1. Thus, another contact surface 5 is created. In case of need, this contact surface 5 may additionally be used as an electrical contact point if the spring member, respectively, spring clip 2 is made of an electrically conductive material.

The multi-stage snap-in function allows electrical components having different diameters or contours to be clamped to and contacted with the same basic construction of the device according to the invention.

As explained before, the spring clip 2 has a freely movable shoulder-shaped portion 10 on each side, which can be pushed downwardly, viz. about the angle W, so as to build up a preload of the spring member force F1'.

The additional locked engagement of the spring clip 2 between the component 3 and the contact plate 1 prevents same from becoming disconnected by itself. The force F1, respectively, F1' in the region of the shoulder dimension of the preloaded spring clip 2, built up as a result of the resilient properties, reduces the shoulder dimension Y as the spring clip 2 is prevented from moving in the direction of force F1 by the locked engagement 1' and 2'. The spring clip 2 attempts to compensate the so created change of length X by reducing the shoulder dimension Y by dimension Y' per side. The spring clip 2 is prevented from doing so, however, as the legs 6, 6' are supported on the component 3 in region Z.

Force F2 acts on the locked engagement by a lever arm on the point of support Z. The greater the force F1 the stronger becomes the force F2, thereby increasing the stability of the locked engagement. Thus, an additional protection against the impact of vibrations is ensured.

Basically, a protection against the loss of contact material is provided on the point of the locked engagement as the current conduction preferably takes place via the contact surface 4.

Insofar, the spring clip 2 may also be made of a non-conducting material, or at least have no electrical connection to the electrical component.

If the spring clip 2 is made of a conductive material without an insulation from the component 3 a current-carrying conductor is formed which tries to stretch if a current flows. Thus, too, an increase of the holding force, respectively, contact force F2 is obtained.

Figure 2:
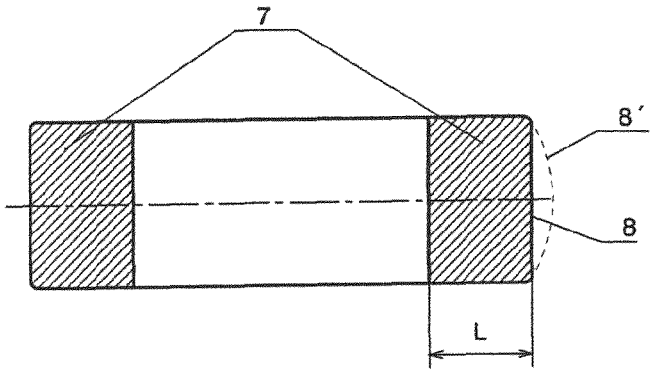
FIG. 2 shows a longitudinal section of the electrical component to be contacted, with contacting portions arranged on the lateral surface of the component in a spaced-apart manner and defining the desired contact surfaces.

The contacting on the contact surface 7 according to FIG. 2 is able to compensate the length tolerances of the component 3 (dimension L) to be clamped or contacted, which constitutes significant advantages in comparison with a contacting on the end faces, where length tolerances are problematical.

The contacting on the lateral surface is here independent of the length and the relative position of the contact surface/lateral surface 7.

Widening the contact surfaces 4 and 5 allows a quasi optional increase of the functional current conduction surface, so that a higher current-carrying capacity is obtained.

The device is furthermore protected against damages, in comparison with a contacting of the end face 8 including a bulge 8'.

Figure 3:
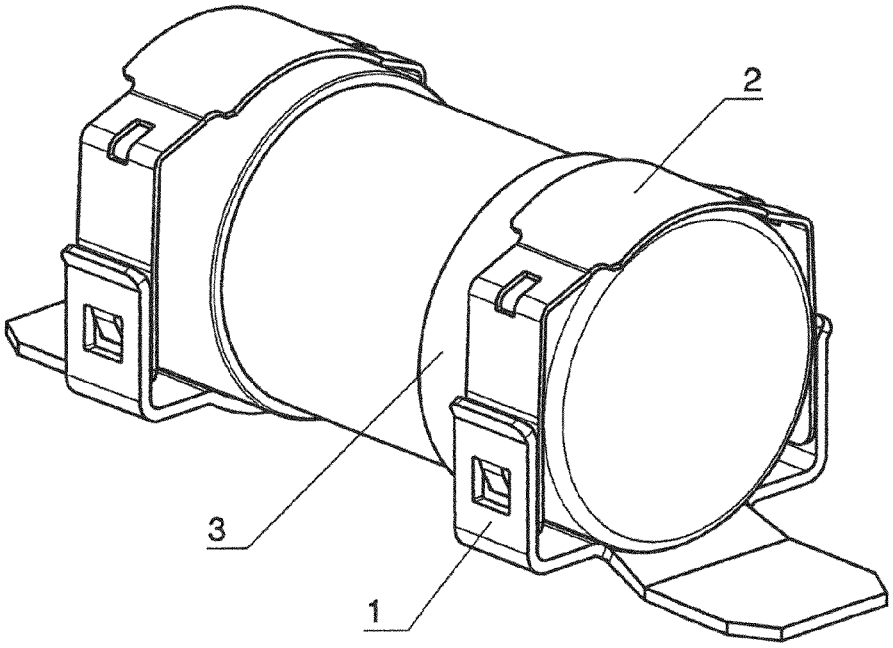
FIGS. 3 and 4 show perspective views of the device according to the invention.
Figure 4:
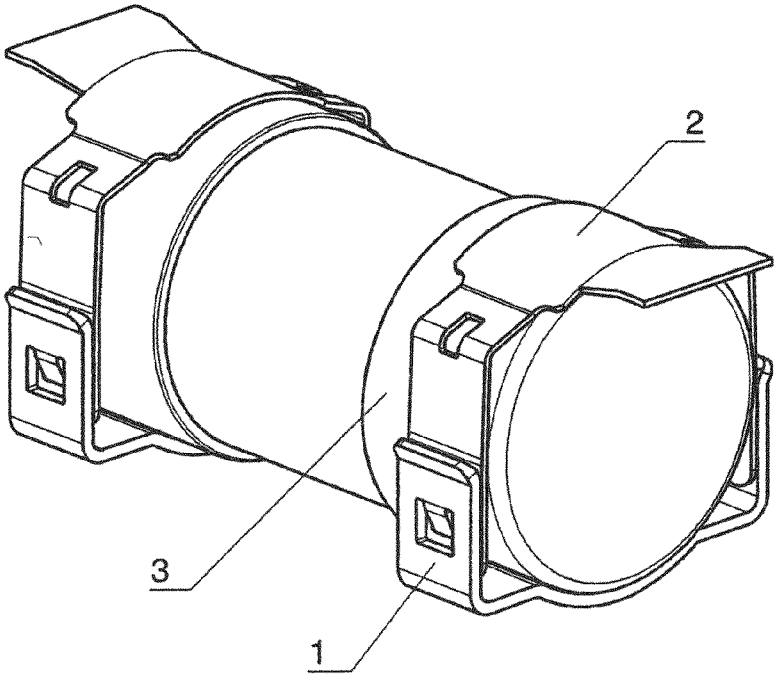

FIGS. 3 and 4 show perspective views of the device for the surge-current-resistant clamped contacting of electrical components according to the invention, e.g. in the form of a fuse.

In the illustration according to FIG. 3 the current conduction takes place primarily via the lower contact jaws 1, with the area of the locked engagement being subjected to an electric load.

If, according to a modification of the invention as shown in FIG. 4, the current is fed and/or discharged via the upper spring clip 2, including the connection parts illustrated there, a portion of the current is conducted both via the contact points 4 and 5 (see FIG. 1) and the conducting spring clip 2 itself, and thus, again, via the locked engagement geometry. If it is assumed that a current-carrying conductor, in this case the spring clip 2, attempts to stretch, the angle U (see FIG. 1) will attempt to expand, so that the contact force F2 acting on the contact jaws 1 is increased, provided that, in this case, the clamping jaws 1 have a greater rigidity than the spring clip 2.

Moreover, in order to further increase the force F2, it is conceivable to electrically insulate, in whole or in part, the contact surface 5 between the clamping jaws 1 and the spring clip 2 so as to deliberate pass the current over the spring clip. In this case, too, controlling the current flow by a choice of the contact resistance on the contact surface 5 would be conceivable. The contact resistance can be influenced by the choice of the material or the nature of the surface.

The ensuing greater contact force results in an improved current conduction, a better fixing of the locked engagement, a possibility of controlling the current flow, and the distribution of the current to several contact points with an overall increase of the current-carrying capacity.

The invention claimed is:

1. An electrical device for surge-current-resistant clamped contacting of at least one electrical component, said at least one electrical component having spaced-apart contacting portions on a lateral surface thereof, said device comprising two U-shaped, electrically conductive contact jaws which have a partial surface that is at least partially complementary to a contour of a respective contacting portion of the electrical component, wherein:

a U-shaped spring clip is assigned to each contact jaw, which likewise includes a partial surface that is complementary to the contour of the respective contacting portion of the electrical component, wherein the partial surface is provided in a connecting portion between legs of the U-shaped spring clip, and wherein the U-shaped spring clip is configured so that in an assembled state, the legs of the spring clip immerse between the lateral surface of the electrical component and a U-leg of a respective contact jaw and are fixed with respect to one another in an engaged manner.

2. The device according to claim 1, wherein snap-in orifices are provided in the legs of the spring clip, in which snap-in catches of the contact jaws engage.

3. The device according to claim 1, wherein the spring clips comprise, in a transition region between the legs and the leg connecting portion, a shoulder-shaped portion which, in the assembled state, builds up a spring force, wherein, the shoulder-shaped portions do not rest against the lateral surface of the electrical component.

4. The device according to claim 1, wherein a current-carrying capacity is predetermined by a size of the partial surfaces of the contact jaws.

5. The device according to claim 1, wherein locked fixing between the clamping jaws and the spring clip is configured to be free from a current flow and the spring clips are configured to be non-conducting, or have an electrical insulating layer or insulating coating.

6. The device according to claim 1, wherein the contact jaws include connection extensions and/or solder contacts.

7. The device according to claim 1, wherein a clear inner distance of the U-legs of the clamping jaws substantially corresponds to a diameter or width of the electrical component in the region of the contacting portions thereof.

8. The device according to claim 1, characterized in that a rigidity and material strength of the clamping jaws are greater than those of the spring clips.

* * * * *